US006056359A

United States Patent [19]

Clark

[11] Patent Number: 6,056,359

[45] Date of Patent: May 2, 2000

[54] TWO-POSITION LATCH SYSTEM

[75] Inventor: Richard N. Clark, Farmington Hills, Mich.

[73] Assignee: Tecla Company Inc., Walled Lake, Mich.

[21] Appl. No.: 08/938,853

[22] Filed: Sep. 26, 1997

[51] Int. Cl.[7] ..... B60N 2/30

[52] U.S. Cl. ..... 297/237; 292/76; 292/80; 292/DIG. 38; 403/329; 297/488

[58] Field of Search ..... 297/236, 237, 297/487, 488; 292/76, 80, 198, DIG. 16, DIG. 17, DIG. 38; 403/326, 329

[56] References Cited

U.S. PATENT DOCUMENTS

| | | | |
|---|---|---|---|
| 1,154,399 | 9/1915 | Hull | 292/76 |
| 1,840,388 | 1/1932 | Dyer | 292/80 X |
| 2,565,636 | 8/1951 | Tinnerman | 292/80 X |
| 4,971,372 | 11/1990 | Gunderson | 292/80 |
| 5,265,934 | 11/1993 | Forget | 297/237 |

FOREIGN PATENT DOCUMENTS

| | | | |
|---|---|---|---|
| 268647 | 4/1927 | United Kingdom | 292/80 |

*Primary Examiner*—Peter R. Brown

*Attorney, Agent, or Firm*—Barnes, Kisselle, Raisch, Choate, Whittemore & Hulbert, P.C.

[57] ABSTRACT

A power boat helmsman's station chair having a two-section seat bottom articulated by a pivotal hinge framework so that the front section of the seat can be folded up from its normal position as a horizontal extension of the rear section of the seat bottom to a position raised and disposed over the rear section. Port and starboard hinge subassemblies include a L-shape angle corner bracket that is fastened to both the bottom and the side boards of the rear seat section framework, thereby reinforcing the same, and that pivotally carries one end of an associated hinge arm fastened at its other end to the framework of the seat bottom front section. A one piece plastic member of generally inverted V-shaped configuration has one arm fixed to the upright flange of the comer bracket with the other arm disposed for spring latching, camming engagement with a cam follower edge surface of the pivot end of the hinge arm. The mobile arm of the spring latch member is cam profile configured and oriented to yieldably hold the hinge arm in the upright position of the seat front section and its spring stabilizing force can be overcome by pulling forwardly on the upright seat bottom front section with a predetermined force to unlatch the same and fold it down to its normal horizontal use position.

30 Claims, 4 Drawing Sheets

TWO-POSITION LATCH SYSTEM

FIELD OF THE INVENTION

This invention relates to pivotal frame work two-position latch systems, and more particularly to a power boat helmsman's station chair having a two-section seat bottom articulated by such a latch system.

BACKGROUND OF THE INVENTION

Framework support systems that are articulated by a hinge or like pivotal support structure for pivoting a section of the framework between two alternate in-use positions, and that are spring-biased so as to be stable in either position, are found in a myriad of applications too numerous to enumerate.

One of such applications to which the present invention is directed involves problems encountered with helmsman operation of power boats or similar water-borne pleasure craft due to the close orientation of the steering wheel and helmsman seat in the helmsman station of the power boat. The seat bottom construction of the helmsman chair is designed to comfortably support the helmsman in seating position with his knees beneath the steering wheel so that the helmsman can comfortably manually grip the steering wheel for guiding the power boat. This requires that the front edge of the seat bottom be located at a lower elevation and only slightly aft of the closest portion of the steering wheel. Hence there is little or no clearance between the steering wheel and the front edge of the seat bottom to allow the helmsman to comfortably stand up and steer the boat with the steering wheel centered in front of him. However, as is often the case when docking, the helmsman needs to quickly standup for better visibility all around the boat, and particularly over the bow. With one-section seat bottoms of fixed construction he cannot do this easily because typically the seat bottom of the helmsman chair is in his way.

In an effort to overcome this problem a helmsman seat bottom construction recently has been provided that is constructed in two sections, a fixed immobile rear section and a movable front section hinged to the main framework of the chair so as to be normally supported in a horizontal position as a horizontal forward extension of the seat bottom rear section. When the aforementioned docking situation arises and the helmsman needs to standup, the front section may be manually pivoted upwardly and rearwardly so as to be disposed over the rear section, thereby providing the needed increase in standing room clearance between the steering wheel and seat bottom.

However this prior swinging front section was stabilized only by gravitational forces in both up and down positions. Although this manner of pivot stabilization is satisfactory for the horizontal position of the front section when the helmsman is sitting on the chair, due to the typical rocking and pitching motion encountered in power boat operation the front section was found to be not satisfactorily stabilized by gravitational forces in the up position, even when the up position was set by stops slightly over-center in the aft direction.

The use of hook and eye type catches or the like is not a satisfactory solution to this stabilization problem since hooking such a catch diverts the attention of the elmsman from control of the power craft precisely at the time when all his attention is most needed for maneuvering. Likewise, although power boat seats are often mounted for fore and aft adjustment on sliding rail constructions, the mechanism for locking the chair in place in adjusted position is not adapted to enable quick, automatic push back of the chair seat to provide the needed standing room clearance.

OBJECTS OF THE INVENTION

Accordingly, an object of the present invention to provide an improved pivotal framework two-position spring latch system adapted to stabilize and support a hinged section of the framework in either of two positions spaced angularly from one another about the pivot axis, and that is particularly adapted for use in combination with the aforementioned two-section helmsman chair seat bottom construction to enable the helmsman to quickly and easily fold up the front of the seat by use of his hand, or by the motion of the back of his legs, as he moves from a sitting to a standing position while docking or in similar close quarters maneuvering situations.

Another object is to provide a pivotal framework latch system for a chair seat bottom construction of the aforementioned or like character that can support the hinged section in a horizontal position with a load bearing downwardly on the same, and which can be folded up and rearwardly to a generally vertical position in which the hinged section is sufficiently strong and stabilized to be load weight bearing in the up position to thereby serve as an alternate elevated seat for enhanced visibility at the helm.

A further object is to provide an improved pivotal framework two-position latch support system of the aforementioned character that is strong, and corrosion resistant so as to be suitable for outdoor saltwater marine use, and which is simple in construction and assembly, hidden from view, non-catching on adjacent seat covering materials, efficient and reliable in operation for the aforementioned purposes and which provides a long service life.

BRIEF DESCRIPTION OF THE DRAWINGS

The foregoing as well as other objects, features and advantages of the present invention will become apparent from the following detailed description of the best mode presently known of making and using the invention, and from the appended claims and accompanying drawings (which are to engineering scale unless otherwise indicated)

DETAILED DESCRIPTION OF THE PREFERRED EMBODIMENTS

Figure 1:
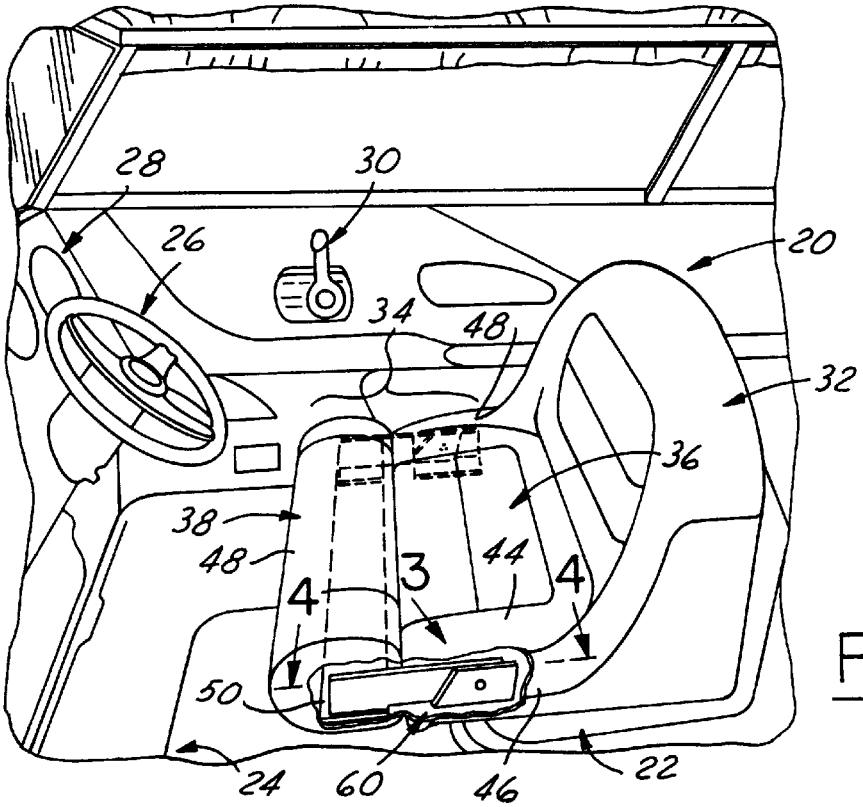
FIG. 1 is a fragmentary perspective view of a power boat helmsman station equipped with a helmsman seat construction incorporating the improved pivotal framework two-position spring latch support system of the invention in a preferred but exemplarily embodiment thereof, and illustrating the helmsman chair bottom seat front section folded down to one of its two stable latched positions for use with the helmsman seated on the chair while manually gripping the steering wheel for normal underway maneuvering of the power boat.
Figure 2:
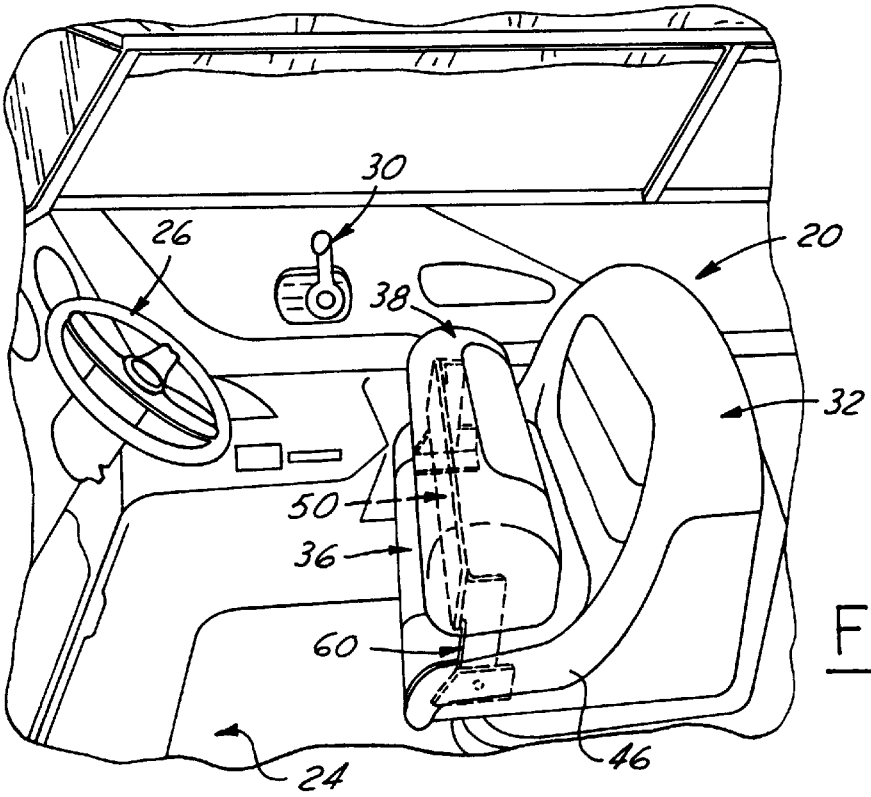
FIG. 2 is a fragmentary perspective view similar to FIG. 1 but illustrating the seat bottom front section folded up and rearwardly to an elevated position vertically above the fixed seat bottom rear section to thereby provide ample standing room clearance for the helmsman to operate the power craft while gripping the steering wheel in a standing position, and also providing an elevated porch to sit on for enhanced visibility at the helm.

Referring in more detail to the accompanying drawings, FIGS. 1 and 2 illustrate the helmsman station of a medium sized power boat of the "cabin cruiser" type. The helmsman station includes a conventionally upholstered helmsman's chair 20 supported in adjustable fixed position by suitable chair rail support structure 22 fastened to the floor deck 24 of the helmsman station, a conventional steering wheel 26, instrument panel 28, and throttle control handle 30. Chair 20 has a fixed seat back 32 extending upright as supported by the internal framework (not shown) of the seat, and a two-section seat bottom 34 made up of a generally horizontally disposed rear section 36 having conventional supporting framework, (not shown), fixed to that of seat back 32 so as to be immobile relative to thereto, and a front section 38 shown in its folded down position in FIG. 1 and its folded up position in FIG. 2.

Figure 3:
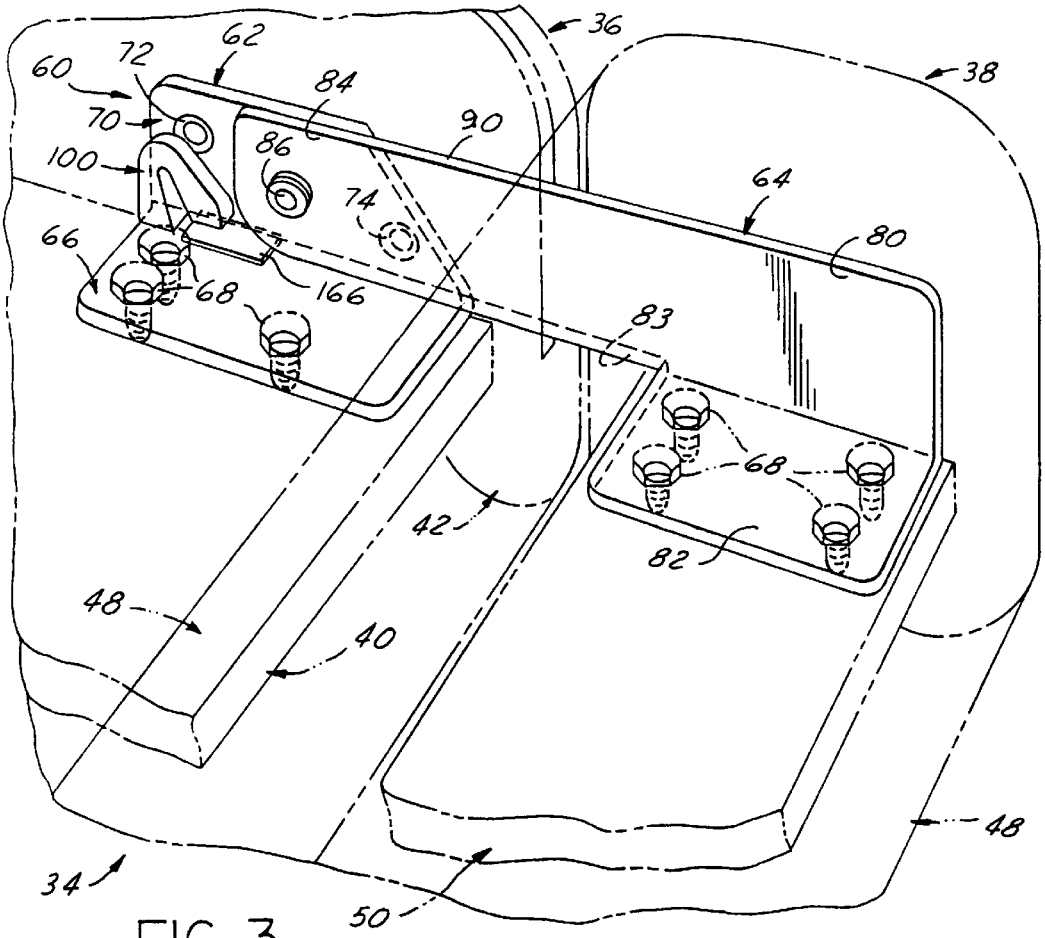
FIG. 3 is a fragmentary perspective view of a portion of the seat construction shown in FIG. 1 looking in the direction of the arrow 3 of FIG. 1 but greatly enlarged to illustrate in more detail the port side spring biased hinge latch construction of the invention.
Figure 4:
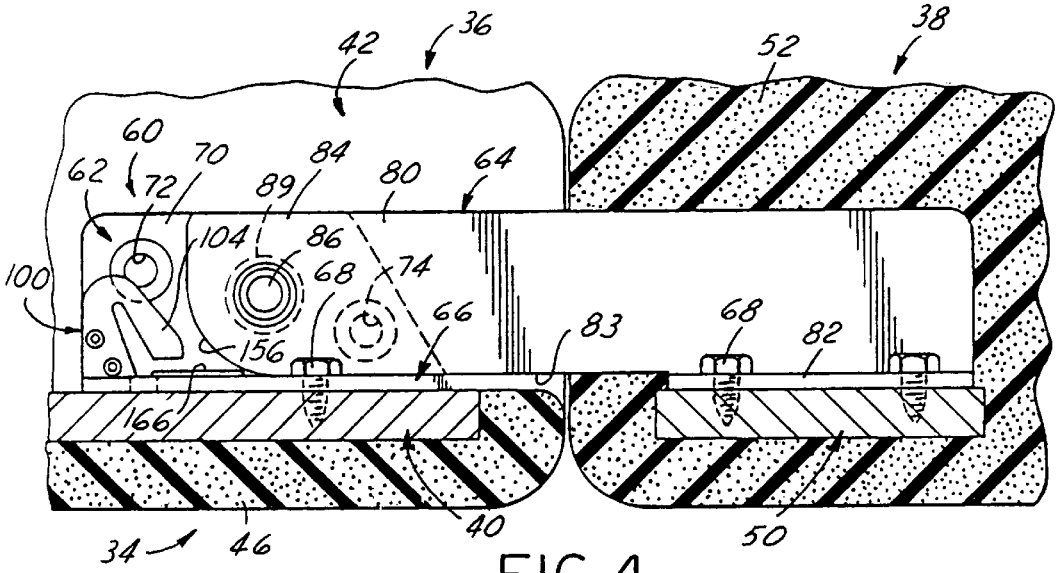
FIG. 4 is a fragmentary cross sectional view taken on the line 4—4 of FIG. 1 and also greatly enlarged thereover.

The interior as well as exterior construction of chair 20 is generally conventional and therefore not shown or described in detail. However, as indicated in FIGS. 3 and 4, rear section 36 of the seat bottom 34 has a bottom board support 40 suitably secured to a pair of flanking side boards, the port side board 42 being partially shown in phantom in FIG. 3 and in solid lines in FIG. 4. A conventional seat cushion 44 (FIG. 1) comprising the usual cushion padding and seat covering materials are suitably mounted on seat bottom board 40, either affixed thereto or made as a separable cushion movably seated thereon. The port and starboard sides of cushion 44 are spaced laterally slightly inwardly from the associated port and starboard arm rests 46 and 48, which in turn may be formed as extensions of back 32 and have cushioning and covering material upholstered to the port and starboard rear section side boards 42.

For clarity of illustration seat cushion 44 is omitted from FIGS. 3 and 4. However FIG. 4 does show a portion of the cushioning material 46 that covers the port arm rest 46 and wraps under the bottom board 40, the same typically being affixed thereto by adhesive material.

The front section 38 of seat bottom 34 likewise is constructed with conventional seat cushion and covering materials to provide a forward cushion 48 with interior conventional foam rubber cushion material 52 (FIG. 4) in which a bottom framework board 50 is embedded.

The articulation and support of the seat bottom front section 38 on chair 20 is provided by port and starboard hinge sub-assemblies constructed as the mirror-image of one another and otherwise being identical. The port hinge sub-assembly 60 is best seen in FIGS. 3 and 4 and comprises two main components, namely a right angle mounting bracket 62 and a pivotally mobile hinge arm 64. Bracket 62 is L-shaped in transverse cross section and has a base flange 66 secured to the upper surface of seat board 40 by three hex-head wood screw studs 68 arranged as shown in FIGS. 3 and 4 and inserted through corresponding through-holes 67 (FIG. 14) in base flange 66. Bracket 62 also has an upright hinge-arm-mounting flange 70 that abuts the adjacent side board 42 and is secured thereto by two flat head screws (not shown) inserted through bevel screw holes 72, 74 (FIGS. 13–15) and located in flange 70 as shown in FIGS. 3 and 4.

Figure 13:
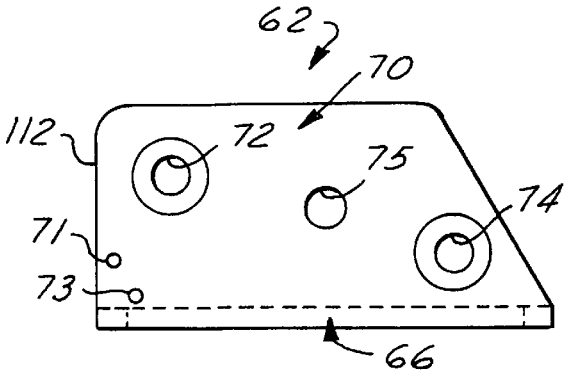
FIGS. 13, 14 and 15 are respectively side elevational, top plan and end elevational views the stationary mounting bracket shown by itself with dimensional values indicated in inches and angulation in degrees.
Figure 15:
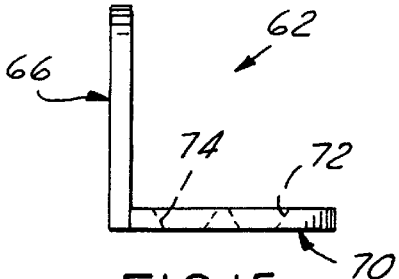
Figure 14:
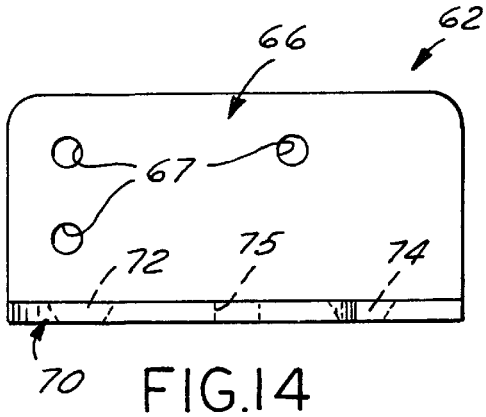

Preferably bracket 62 is constructed as shown in FIGS. 13–15 as a one piece 90° angle extrusion of aluminum material of 3/16 inch thickness, each flange of the angle piece being 2 inches wide by 4 inches long.

The mobile hinge arm 64 of hinge sub-assembly 60 is likewise preferably of a one-piece aluminum extrusion construction comprising an elongated arm piece 80 and a mounting base 82 each 3/16 inch thick of 2 inch width. Base piece 82 is suitably sized to fit frame board 50 and thus is machined away down to a length of say 3⅜ inches, whereas arm piece 80 remains longitudinally elongated so as to have length dimension of say approximately 8½ inches.

The distal end 84 of arm 80 is pivotally secured to mounting flange 70 of bracket 62 by a pivot rivet 86 inserted through aligned rivet holes 75 and 85 in flange 70 and arm end 84 respectively located in these parts as best seen in FIGS. 4–9, 11, 13 and 14. The flange end of hinge arm 64 is secured to frame board 50 by four hex head wood screws 68 inserted through drilled holes 83' in flange base 32 (FIG. 12) and screwed into board 50 in the locations and manner shown in FIGS. 3 and 4.

As will be evident from FIGS. 1, 3 and 4, wherein the bottom seat 34 is shown with front section 38 folded down to its horizontal position to serve as a horizontal extension of bottom seat rear section 36, front section 38 is gravity biased to remain in this down position with the straight longitudinal under edge surface 82 of arm 80 resting on the upper surface of the bracket base flange 66, as best seen in FIG. 4. Normally the weight of the padding and frame board construction of seat front section 38 is sufficient to maintain it relatively stable in the folded down position solely under the influence of the gravitational forces exerted from the center of gravity of the front section 38 through the moment arm measured to the pivot axis of arm 64 on bracket 62.

Figure 8:
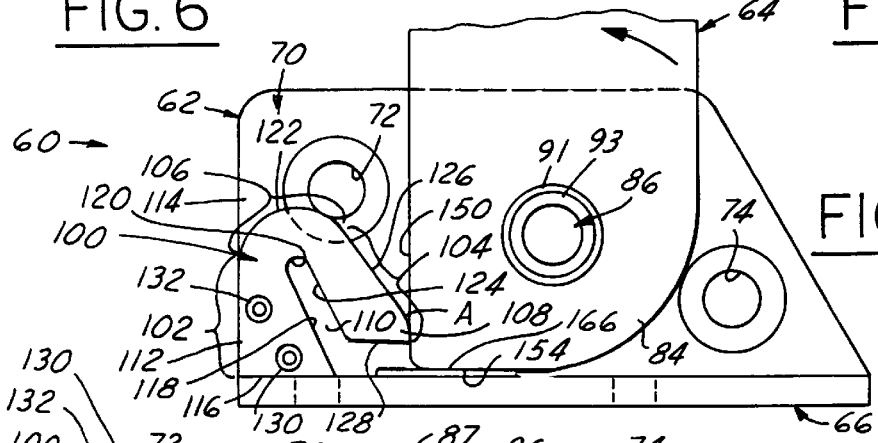
FIG. 8 is a view similar to FIGS. 5–7 illustrating the hinge arm pivoted all the way up into its alternate stabilized position, corresponding to the seat bottom front section being folded up and back to its fully elevated position of FIG. 2.

However with the aforementioned prior art two-section fold up seat construction it was found that the front section 38 was not sufficiently so stabilized solely by gravitational biasing in the folded-up position. This prior art fold up two-section bottom seat construction was generally the same as the fold up seat bottom construction of the present invention to the extent described thus far, except for certain significant differences therebetween. The prior construction did not have the two screw holes 72, 74 for mounting the upper edge flange 70 of the bracket to the side board 42. Instead hole 72 was in the form a threaded through-hole which received a stud that mounted a stop block to the inner surface of flange 70 so that the upper longitudinal straight edge surface 90 of the prior pivot arm 64 abutted the edge of the stop block when arm 64 was positioned as shown in FIG. 8 to provide a positive arm stop for the tilt up and back travel of the seat front section with the longitudinal center line of arm 64 positioned about 5° past vertical (with flange base 66 oriented horizontally). This "over-center" position of the center of gravity of seat section 38 in its up position was sufficient to maintain it in this position when the power boat was operating in quiet-water conditions, and assuming the helmsman did not inadvertently knock the front section down by body movements while manipulating the steering wheel or otherwise moving about the helmsman station. However, in rough water or when the power boat was decelerated and/or the power boat was in a bow-down orientation, the minimal gravity stabilizing force for maintaining the seat front section in up position was found insufficient to hold it in this position, and instead the same would readily and undesirably flop down under such conditions.

Moreover when the helmsman wished to use the front section 38 as a elevated seat cushion with the same in the tilted up position of FIG. 2, its gravity stabilization in this up position was often found insufficient to prevent it from flopping to the down position under the weight and movements of the helmsman and/or those of the water craft.

In addition, the distal end of the arm 64 in the prior construction was merely radiused through 180° to provide a round nose that was spaced with a large clearance away from the upper surface of base flange 66 of bracket 62. Hence when the helmsman was sitting on the seat front section in its tilted up position, the entire weight of the helmsman was carried on the two pivot fasteners of the port and starboard hinge arms. Due to normal vibration and bouncing caused by the motion of the boat on the water, the pivot fasteners supporting this weight would tend to wear and loosen, thereby inducing rattling noises and shortening the service life of the pivotal frame articulation of the seat.

The foregoing instability and wear problems of the prior art fold up two-section seat bottom construction were found to render the same generally unsatisfactory in use. Accordingly, it was necessary to undertake a design and engineering effort in an attempt to resolve these problems by providing some type of stabilizing latch system for maintaining the front section folded up in a stable position but without changing the mode of operating the fold up section for tilting it up and down, i.e., without the necessity of requiring the helmsman to manually manipulate some sort of hook latch or similar device to hold the seat stable in the folded up position. The pivotal frame work spring latch system of the invention resulted from this effort and, with a minimum redesign of the prior parts, overcame the aforementioned problems of the prior art construction while achieving the aforestated objects by providing several novel features which will now be described in detail.

Figure 9:
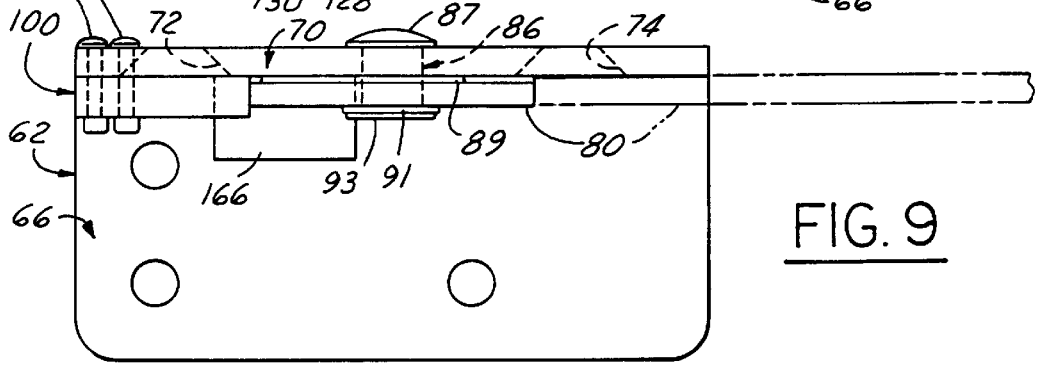
FIG. 9 is a top plan view of the structure shown in FIG. 8.

In accordance with one principal novel feature of the present invention, a one-piece stabilizing spring latch member 100 is provided on the stationary seat bracket 62, as shown in FIGS. 3–9. Spring latch member 100 is mounted generally in the location of the aforementioned fixed stop plate, which in turn is eliminated along with its machine screw mounting stud and associated mounting hole in flange 70. As described in detail with reference to FIGS. 8 and 10, spring latch member 100 in the presently preferred embodiment is injection molded from suitable plastic material so as to have uniform thickness dimension throughout (as shown in FIG. 9). Alternatively, member 100 may be molded so as to have an "I" beam configuration in transverse cross section taken in a plane perpendicular to the plane of the drawing. In the side views of FIGS. 8 and 10 it will be seen that member 100 is an inverted generally V-shaped member that may be analyzed as having three functional as well as structural portions, namely, (1) a mounting arm portion 102, (2) a yieldably movable latch arm portion 104 and (3) a bight portion 106 integrally resiliently interconnecting the arm portions 102 and 104. As shown in FIGS. 8 and 3 and 4 in the free state condition of member 100 the free end 108 of movable arm portion 104 is held spaced away from the mounting arm portion 102, and a tapered flexing space 110 is provided between these arm proportions to permit flexing motion of arm portion 104 relative to the mounting arm portion 102 in the plane of the drawing, i.e. parallel to the adjacent side face of bracket flange 70.

The mounting arm portion 102 of spring latch member 100 has a straight outer side surface 112 that in the mounted condition is flush with the side edge 114 of bracket flange 70. The bottom edge 116 of arm portion 102 is perpendicular to side edge 112 and is adapted to seat squarely on the upper surface of bracket base flange 66. The inner side surface 118 of arm portion 102 has an included angle with edge 116 of about 65° so that arm portion 102 has a narrowing taper, in side view, to its junction with bight portion 106.

Figure 10:
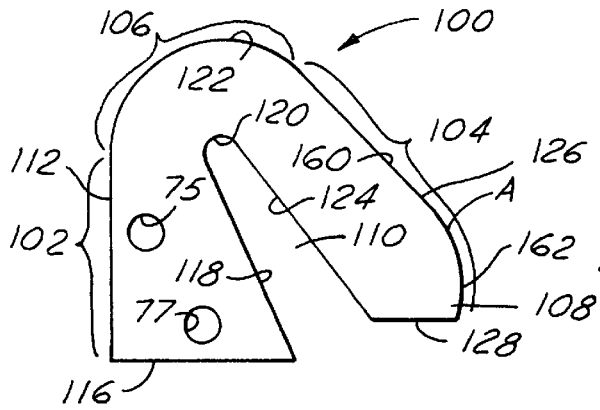
FIG. 10 is an elevational view of the spring latch member shown by itself and enlarged over the showings thereof in the assembly views of FIGS. 3–9, and being shown to scale with dimensional values (in inches) indicated thereon.

Bight portion 106 of member 100 has concentric inner and outer curved surfaces 120 and 122 each having a uniform radius of curvature about their common center of curvature (FIG. 10). Bight portion 106 extends for approximately 135° about the center of curvature from its integral junction with the upper end of arm portion 102 to its integral junction with the upper end of movable arm portion 104.

Movable arm portion 104 has an inner side edge 124 that defines an included free-state angle with the outer side edge 112 of mounting arm portion 102 of about 53° so that flexing space 110 has a divergent taper widening toward its mouth. The outer side edge surface 126 of movable arm portion 104 is configured as a camming surface having a generally convex configuration oriented in the travel plane of swinging motion of movable arm portion 104. This generally convex configuration converges at a high point apex A spaced upwardly a short distance from the free end edge surface 128 of arm portion 104(FIG. 10). Preferably the outer edge surface 126 of arm portion 104 is made up of a long straight line portion 160 (FIG. 10) extending from edge 122 of bight portion 106 to a curved surface defining apex A and having a uniform radius of curvature oriented tangentially with the straight section 160 and merging into another short straight section 162 that perpendicularly intersects the free end edge 128.

Spring latch member 100 is fixedly mounted on bracket 60 by a pair of pop rivets 130 and 132 and, as shown in FIGS. 8 and 9, with the upset ends of rivets oriented against the inboard face of spring latch member 100. Suitable through-holes 71 and 73 are provided in bracket flange 70 (FIG. 13) and corresponding holes 75 and 77 in mounting arm portion 102 of member 100 (FIG. 10), these rivet holes being precision located and precision machined to thereby precision mount member 100 in the aforementioned location on bracket 60.

Preferably spring latch member 100 is injection molded from suitable semi-resilient plastic material such as that sold under the trademark Delrin® or equivalent material, having a low coefficient of friction and sufficient self-lubrosity to reduce sliding friction when engaged by the cam follower surfaces of arm 64, as explained in more detail hereinafter. In the preferred but exemplarily working embodiment disclosed in FIGS. 1–15 and dimensioned as set forth in FIGS. 10–15 the uniform thickness of spring latch member 100 is about 0.25 inch. When so constructed and dimensioned as shown in FIG. 10 the spring rate of member 100 is designed to provide a five pound breakaway force during the tilt-down operation of the front section 38 of chair 20.

It is to be noted that the spring rate of the spring latch member 100 can be readily adjusted by initial design without a changing its external configuration or dimensions merely by molding or machining a different diameter into the half circle surface 120, e.g., enlarging its diameter over that shown will reduce the spring rate as desired by reducing the width dimension of the resilient portion 106 of member 100.

In addition, when so constructed, spring latch member 100 will not corrode under the influence of salt air or water, and will maintain the shape of the concave camming surface 126 through repetitive cycling to provide a long operational service life.

Moreover, in accordance with a further feature of the invention it is to be noted that spring latch member 100 while serving as a stabilizing spring for the up and down positions of arm 64 (FIGS. 8 and 4 respectively), is nevertheless designed such that arm 64 and the movable arm portion 104 are fully disengaged in both the up and down positions. Hence latch member 100 can assume its free state condition in both of these latch positions and therefore is not stressed or under tension and/or compression stresses in the bight portion 106 of the spring in either of these positions. Because the plastic material of member 100 is not so loaded in either the up or down position, the problem of "creep", common to most if not all plastic materials when the same are under a constant load, is eliminated. Hence the operational position of movable arm portion 104 relative to hinge arm 80 in subassembly 60 will be accurately maintained throughout a long service life. The effects of stress fatigue on the spring are also thereby greatly reduced, thereby ensuring that the spring rate of member 100 will remain more uniform and constant throughout its service life, and that such will not be prematurely foreshortened by stress fatigue failure.

In accordance with another principal feature of the present invention the distal end 84 of hinge arm 64 is specially reconfigured by precision CNC machining or stamping die cutting its end edge surfaces to operate as a sliding cam follower relative to spring arm 100, and also to operate as a weight bearing surface in the up position of arm 64. The pivot hole 85 (FIG. 11) in the distal end 84 of arm 64 is also precision machined to precision locate the cam follower edge surfaces 150, 152 and 154 of the distal end 84 relative to the operative portions of camming surface 104 of spring member 100, and in turn the precision mounting position of member 100 is determined by the precision pop rivet holes 71 and 73 (FIG. 13) formed in mounting flange 70 of mounting bracket 62. The rivet hole 75 (FIG. 13) in mounting flange 70 is also precision machined and located relative to holes 71 and 73.

Figure 6:
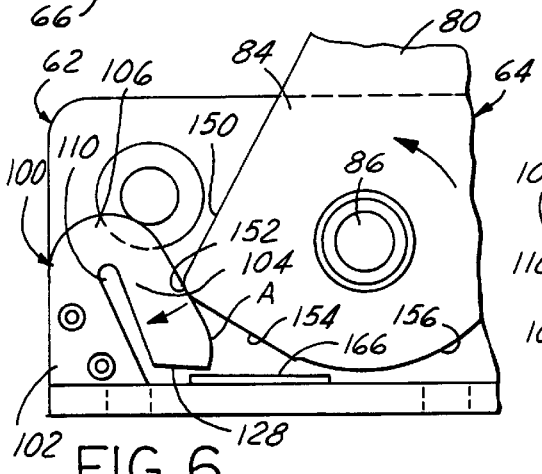
FIG. 6 is a fragmentary view similar to FIG. 5 but illustrating the hinge arm pivoted upwardly slightly farther, thereby producing an initial increment of deflection of the movable arm of the spring latch member.
Figure 11:
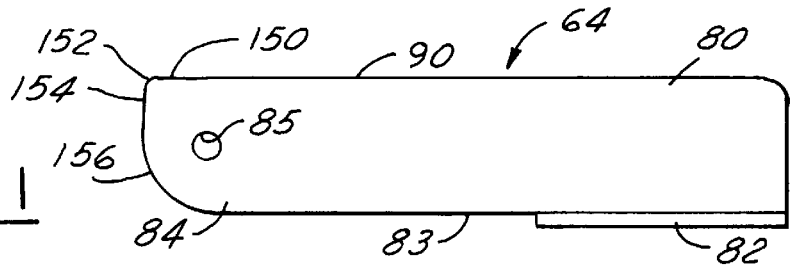
FIGS. 11 and 12 are respectively side elevational and bottom plan views of the hinge arm shown by itself with dimensional values indicated in inches and angulation shown in degrees.
Figure 12:
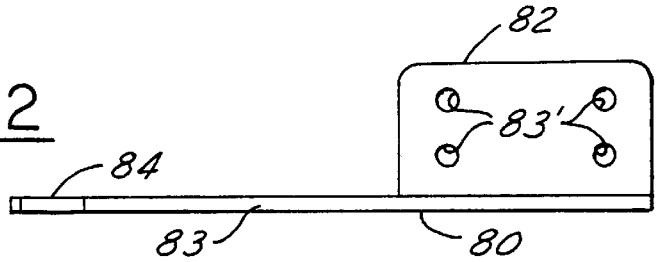

More particularly, referring to FIGS. 6 and 11 the cam follower means provided on the distal end 84 of mobile hinge arm 64 consists of a straight line edge surface extension 150 of the upper longitudinal edge surface 90 of arm 80. Surface 150 extends to a curved nose surface 152 having a uniform radius of curvature which merges into a transverse end edge surface 154–156. A straight first edge surface portion 154 extends generally perpendicular to edge 150, but preferably defining an obtuse included angle of 95° with edge 90 of arm 80 (FIG. 11). The camming follower surface provided by the transverse end edge surface of arm 80 has a curved second portion edge surface 156 extending smoothly from its merger with the first edge surface portion 154 and having a uniform radius of curvature to merge with a second longitudinal edge surface 83 surface of arm 80, namely, the underside arm longitudinal edge 83 that extends parallel to and opposite the upper arm longitudinal edge 90. In the preferred example as disclosed herein, these cam follower edge surfaces of the distal end 84 of arm 80 are machined or die cut to the dimensions and locations shown in FIG. 11.

In accordance with a further construction and assembly feature of the invention, spring latch member 100 is fixedly and securely mounted to mounting flange 70 of bracket 62 by the aforementioned pop rivets 130, 132 in a precision location with its lower flat edge 116 firmly seated on the upper surface of base flange 66 of bracket 62. In addition hinge arm pivot rivet 86 is installed in bracket 62 with its head 87 oriented outboard of bracket flange 70, as are the heads of pop rivets 130 and 132. A spacer washer 89 is inserted onto the shank of rivet 86 between flange 70 and arm 64, and another washer 91 is installed between bracket 64 and the swedged-over portion 93 of rivet 86 (FIGS. 8 and 9).

Preferably, the foregoing assembly of bracket hinge arm 64 and rivet 86 is completed at the point of manufacture of the pivot hinge sub-assembly 60, but the assembly of spring latch member 100 is completed at the point of construction of bottom seat 34. This sequence cooperates with the two screw mounting holes 72 and 74 in bracket flange 70 which are designed with their beveled counter sinks to individually receive the conical shoulder of a flat head screw with the outer head face of the screw flush with (or preferably recessed from) the inboard surface of bracket flange 70. The provision of additional screw holes 72 and 74 thus enables bracket 62 to be screw-secured to either, but preferably to both, the seat frame side board 72 and the seat bottom board 40 of the rear section 36 of the seat bottom 34, while carrying pop rivets 130, 132 loosely preinstalled in their unfinished, pre-upset condition so as to protrude inboard from flange 70. After so mounting bracket 62 to the seat boards with the two flat head screws (not shown) bottomed in their respective bracket holes 72 and 74, arm 100 is then assembled to bracket 62 by registering and sliding it onto the protruding ends of the pop rivets. The pop rivets 130 and 132 are then severed and swedged by the pop rivet tool, access to the pop rivet ends for the tool thus being available at the inboard side of bracket flange 70. It thus will also be seen that angle bracket 62 serves to provide a comer reinforcement for the seat construction as well having both of its flanges securely fastened to the seat to thereby more securely support hinge bracket arm 64 in use. It also enables the bracket to be mounted to either a vertical or a horizontal mounting surface in those applications where only one such surface is available. Spacer washer 89 is preferably made of plastic, such as that sold under the brand name Mylar®, and serves to eliminate any metal-to-metal contact between the bracket flange 70 and the adjacent surface of arm 80. Spacer washer 89 also spaces the outboard side of the arm 80 away from the heads of the mounting screws secured in holes 72 and 74 and hence insures arm swing clearance in the event that they should protrude slightly beyond flush condition in some assembly situations.

The operation of the pivotal framework latch system 60 of the invention as applied to the improved helmsman chair 20 embodiment of the invention will become apparent from the foregoing description, as well as from the incremental sequence of positions of hinge arm 80 illustrated in sequence in FIGS. 5–8, as seat front section 38 is moved from its horizontal in-use position of FIG. 4 vertically upwardly and rearwardly over rear seat section 36 and vice versa. In the fully tilted down-position of front section 38 (FIGS. 1, 3 and 4) it will be seen that front section 38 is cantilever supported from the stationary seat rear section 36 by the starboard and port pivotal framework latch system subassemblies 60. Frame board 40 in turn, is conventionally affixed to the main framework of chair 20 (not shown). In this down position the lower longitudinal edge 83 of arm 80 abuts the upper surface of flange base 66 which thereby serves as the end limit stop for downward pivotal motion on pivot rivet 86. In this position the movable arm portion 104 of spring latch 100 is spaced with a relatively large clearance away from the curved end edge surface 156 of arm 80 so that spring member 100 can assume its free state position and thereby allow the spring section 106 thereof to be in a relaxed, non-stressed mode.

In this tilt down condition of seat bottom 34 the helmsman would normally be seated while gripping the steering wheel 26 in the normal mode of the sitting position with most of his weight carried on the rear seat section 36, with the undersides of his thighs bearing on front seat section 38 and with his feet resting on the cabin deck floor 24. Although front section 38 is designed in a tilt down position under normal in-use conditions to bear the full weight of the helmsman when in a sitting position solely on section 38, or even when standing thereon, most of the weight stress normally imparted by the seated helmsman is born by the rear seat section 36. Accordingly gravity biasing is sufficient to maintain the front seat section 38 in the down position without the need for stabilization forces to be exerted by spring latch 100 on arm 80 with the seat front section 38 in this position. This is true even with the bottom seat 34 vacant inasmuch as the weight of front section 38 alone is sufficient to maintain the same in the fully tilt down position of FIGS. 1, 3 and 4. Under such seat-vacated conditions the helmsman station is normally unoccupied and hence the power boat is normally not underway and thus bouncing forces are not being generated.

Now when the helmsman has a need to both quickly stand up and steer, as he so rises from a sitting to standing position he can keep one hand on the steering wheel 26 and with the other hand grip front seat section 38 anywhere along its forward edge, then easily and quickly tilt the same up and back to the fully tilted up position of FIGS. 2, 8 and 9. During this tilt up motion hinge arm cam follower surface 154 swings into initial contact with the straight inclined portion 160 of latch arm camming surface 126, as shown by the movement from the position of FIG. 4 to the position of FIG. 5. Thus during this first approximately 45° increment of upward pivotal motion from horizontal, spring latch member 100 offers no resistance to lift up of the seat front section 38.

Figure 5:
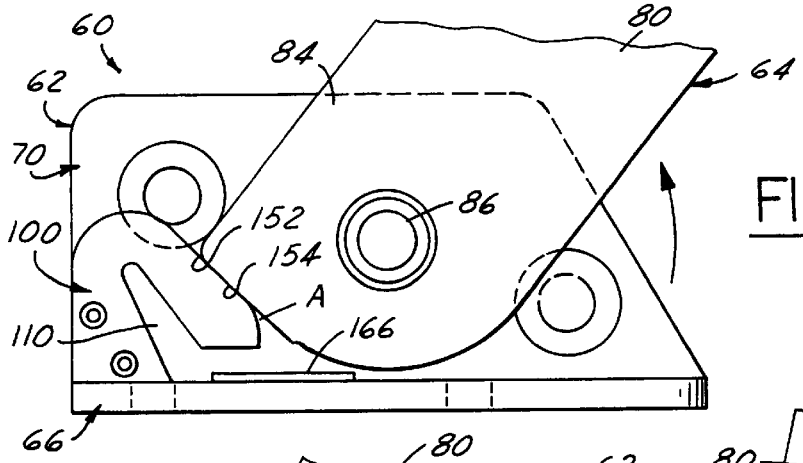
FIG. 5 is a fragmentary view illustrating the mounting bracket, spring latch and pivotal hinge arm portion of the structure of FIG. 3, but with the hinge arm pivoted upwardly into initial camming engagement with the stabilizing spring latch member of the latch mechanism of the invention.

During the next increment of upward pivotal motion of arm 80 counterclockwise (as viewed in FIGS. 5–8), that is, during the approximately of 20° of rotation from the position of FIG. 5 to the position of FIG. 6, the small radius arm nose 152 bears slidably against and along straight surface 160 of camming surface 126 as arm 80 swings about the axis of pivot 86. During this travel cam 20° engagement increment, hinge arm nose 152 progressively forces the latch movable arm portion 104 to swing toward latch mounting portion 102, thereby partially closing the swing clearance space 110. Due to the tapering geometry of spring latch member 100, wherein both of the arm portions 102 and 104 narrow in width as they merge with the narrowest bight portion 106, most of the spring flexing in member 100 to accommodate this motion of arm 104 will occur in the yieldably, semi-resilient bight portion 106 of member 100. Thus, although all of the material of member 100 is uniformly resilient throughout, this design geometry of member 100 concentrates the spring action in bight 106.

Figure 7:
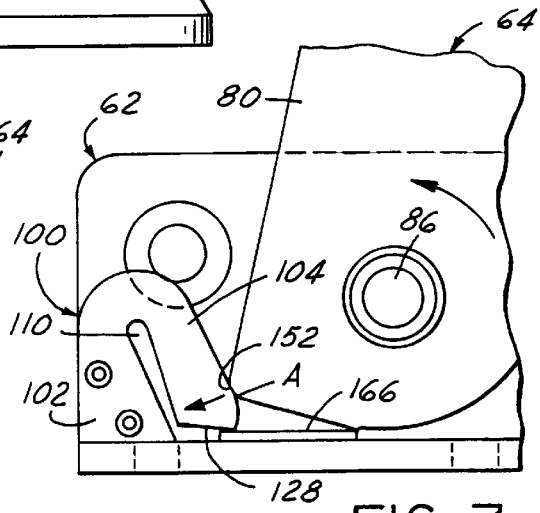
FIG. 7 is a view similar to FIG. 6 illustrating the hinge arm pivoted still farther upwardly, and showing the corresponding further resultant deflection of the mobile arm of the spring latch member.

During the next approximately 10° of angular incremental pivoting of arm 80, in moving from the position of FIG. 6 to the position of FIG. 7, the cam follower nose 152 slides further along camming surface 126 and further deflects arm 104 towards arm 102, as resisted by the yieldable biasing force of member 100, until nose 152 reaches apex A of surface 126. Thus is the unstable on-center position of the articulation of the camming engagement of the cam follower surfaces 150–156 of arm 80 relative to the camming surface 126 of member 100.

When arm 80 is swung further from the position of FIG. 7 to the position of FIG. 8 in the last approximately 15° of angular incremental pivotal travel, nose 152 rides down the short straight portion 162 of surface 126 (FIG. 10). During this last increment the articulation geometry is such that the spring resistance forces being exerted by arm 104 through arm surface 162 against surface 150 of arm 80 tends to assist, rather than to retard, pivotal motion of the arm to its final full-up position shown in FIG. 8.

Once the seat front section 38 is thus fully tilted up the arm camming surface 154 will abut the upper surface of a plastic abutment pad 166. Pad 166 is adhered to the upper surface of bracket flange 66 to cover the area beneath surface 154 of arm 80 in the full-up position and also beneath the end surface 128 of arm 104. Preferably pad 166 is made of high density polyethylene and thus serves to prevent metal-to-metal contact between arm 80 and flange 66. Preferably end surface 128 of arm 104 is dimensioned so that it is either closely spaced from or in light contact with pad 166 at the point of maximum deflection of arm 104 (FIG. 7). Alternatively, a slight interference can be provided between surface 128 and the upper surface of pad 166 with arm 80 in the full-up position if it is desired to augment the spring resistance forces developed by latch member 100.

As a further feature of the invention, it will be seen from the foregoing that in the fully tilted up position of seat front section 38 (FIG. 2) the weight load exerted from the center of gravity of the seat front section 38 is born primarily by the two pivot rivets 86 and transmitted therefrom downwardly through the vertical flanges 70 into the base flange 66 and then into the support board 40. However, some of the weight load is also carried directly from port and starboard arm 80 through the bearing of their end surface 154 on pad 166 into base flange 66. Pad 166 thereby serves as a load bearing take-up support to limit the maximum weight loading applied to rivets 86. Due to this feature the rivets will not be damaged or unduly worn when the helmsman sits or stands on front seat section 38 when in its fully tilted up position of FIG. 2.

It will also be seen that seat front section 38 is stabilized and latched in the upright position by port and starboard spring latch members 100 returning to their free state condition shown in FIG. 8. Surface 162 of each arm 104 is now positioned either closely adjacent or in light contact with surface 150 of the associated arm 80. Hence any tilt down forces exerted on front seat section tending rotate arm 80 clockwise as viewed in FIG. 8 will cause surface 150 to slidably abut and be opposed by the full strength of the spring resistance force of member 100 tending to maintain arm 104 in the free state condition of member 100. Note also that arm 80 has a minimum leverage geometry in this condition. This cooperative latching relationship is thus fully sufficient to maintain seat front section 38 in the fully upright position against those inertial forces induced by boat motion as well as those gravitational forces exerted by front section 38 that act in a tilt down direction. The latching strength is also sufficient to maintain seat 38 upright when the helmsman sits or even stands on the same when it is folded up as in FIG. 2.

However, when it is desired to purposely move front section 38 from the full fold-up position of FIG. 2 down to the horizontal, seat extension position of FIG. 1, the resistancy forces exerted by the latching action of springs 100 can be readily overcome by gripping the back of section 38 and pulling it forwardly and downwardly. Preferably, the spring latch system is designed so that a five pound force exerted in this manner is sufficient to overcome the resistance of the spring latches as arms 80 are pivoted from their position in FIG. 8 clockwise to their position in FIG. 7. Once pivoted this far the seat front section 38 is unlatched, whereupon it will be pivoted further downwardly to the fold down position of FIG. 1 due to the weight forces exerted from the center of gravity acting around axis of pivot 86 as well by the "kick" exerted by arm 104 as it flexes from the stressed position of FIG. 7 to the free state position of FIG. 5.

From the foregoing description it will now be apparent that the pivotal framework latch system, as well as the application thereof to a two-section fold-up seat bottom helmsman chair construction in accordance with the foregoing features of the invention, fully achieves the aforestated objects and provides many advantages over prior two-section articulated pivoted framework latch systems. The two spring latch members 100 of the port and starboard pivotal framework latch system subassemblies 60 operate conjointly and simultaneously in an additive manner to smoothly latch the pivot arms 80 in their upright position. From the full down position of front section 38 of FIG. 1 the same can be easily pivoted up to smoothly slidably engage the port and starboard spring latches with maximum leverage. From its fully tilted up position front seat section 38 can be intentionally manually unlatched by simply rotating it to the down position with enough forwardly directed pull force to overcome the spring bias resistance forces of the latch system. The spring latch members 100 are thus designed with enough strength to hold front section 38 securely in its full up position, but not so strong that they cannot be easily overcome to unlatch the front seat section to tilt it down when sufficient pull force is properly manually applied to the rear of the front seat section.

Spring latch members 100 are in their free state condition in both the up and down position of seat front section 38 and hence are not placed under tension or loaded in either the up or down positions of the seat section. This is particularly desirable feature when latch springs 100 are made of semi-resilient plastic material as described previously because it eliminates the "creep" problem of most plastic materials that occurs when plastic is held under a constant load, and also reduces the likelihood stress-induced fatigue failure. The lubricity of the preferred Delrin® plastic material makes the camming slide action a smooth motion when the aluminum plate arms 80 are rotated up or down. The plastic spacer washer 89 encircling rivet 86 between pivot arm 80 and bracket flange 70 eliminates metal-to-metal contact between these moving parts. Likewise the plastic strip or pad 166 in the landing area of arm cam surface 154 prevents metal-to-metal contact when a downloading is applied to seat front section 38 in its upright position, and also helps absorb and share the downward loading applied to the pivot rivets 86.

Due to the geometry and materials of the latch system the same is essentially noiseless in operation and is highly corrosion resistant, rendering it ideal for marine usages. Preferably the hinge arm 64 and bracket 62 are also electrostatically coated with a powder coat of paint. Preferably this paint powder is an epoxy material to further enhance corrosion resistance as well as appearance, and preferably selected as to color to match that of the upholstery cover materials of chair 20.

The latch spring members 100 can be easily attached to bracket 62 during seat construction after screw mounting of bracket 62 to both the bottom board 40 and the side board 36 of the seat rear section 36 due to the use of pop rivets 130, 132 that are pre-installed with their finished heads outboard. The latch spring member 100 can be design "tuned" by adjusting the cross sectional dimension of bight portion 106 (the dimension in the plane of drawing in FIG. 10) by precision boring or molding the desired radius of curvature in the inner bight surface 120. Hence the latch spring-to-pivot arm mounting location and external geometrical shape of the component parts hinge latch assembly 60 can remain fixed for ease and economy of manufacture, and yet the spring rate adjusted as desired by utilizing either a simple drilling or boring operation performed on the finished latch spring member 100 during the process of its separate production, or by simply changing a suitably dimensional insert in the injection mold.

It will also be apparent to those skilled in the art from the foregoing description and drawings that the pivotal framework latch system of the invention is useful for a variety of applications other than a two-section bottom seat of a helmsman chair. It can be advantageously used almost anywhere where corrosion is a problem. It also can be used in any application where a pivotal framework needs to latched, for example, a fold up foot rest, a folding shelf hinge assembly, a door latch spring application, etc. It now will also be understood that different materials can be used for the latch spring member 100. For example, member 100 can be constructed solely of spring metal, or of a plastic coated metal spring laminate.

It thus will be understood from the foregoing disclosure that the principles of the invention are applicable to a variety of pivotal framework latch system applications and hence the invention is intended to be limited only by the applicable prior art and the appended claims.

I claim:

1. A pivotal framework subassembly latch system comprising, in combination, a spring latch member having a mounting arm portion, a yieldably movable latch arm portion having a free end, and a bight portion integrally resiliently connecting said arm portions remote from said free end and holding said latch arm portion spaced away from said mounting aim portion in the free state condition of said latch member to thereby define a flexing space therebetween for pivotal motion of said latch am portion free end relative to said mounting arm portion in a travel plane of said latch arm portion free end, said latch arm portion having a camming surface on a side thereof remote from said mounting arm portion with a generally convex configuration oriented in the travel plane of said latch arm portion free end and defining an apex generally adjacent said free end, said framework system further including support bracket means, fastening means fixedly securing said mounting arm portion to said bracket means against movement thereon, and a mobile hinge arm having one end thereof secured by pivot support means to said bracket means for pivotal motion of said hinge arm between first and second angularly spaced end limits for swinging generally in a hinge arm travel plane coplanar to the travel plane of said latch arm portion free end, said one end of said hinge arm carrying cam follower means constructed and arranged to engage said latch arm camming surface for travel therealong on either side of and over said apex in an over-center relationship, as said hinge arm pivots between its swinging end limits, and such that said cam follower means forces said latch arm portion to yieldably swing toward said mounting arm portion during such cam follower engagement over said apex while being yieldably resisted by the biasing force exerted by said resilient bight portion as the same flexes to accommodate such swinging of said latch arm portion whereby said hinge arm is yieldably latched into either one of two angular spaced latched positions at or between its swing end limits.

2. The latch system of claim 1 wherein said hinge arm one end and said support bracket means are constructed and arranged to form first and second mutual engagement positive stops defining the respective swing end limit positions of said hinge arm.

3. The latch system of claim 2 wherein said cam follower means and said latch arm portion camming surface are constructed and arranged for disengagement when said hinge arm is in either one of said latched positions so that said spring latch member is in its free state condition when said hinge arm is in either of said latched positions thereof.

4. The latch system of claim 3 wherein said hinge arm latched positions generally coincide with said hinge arm positive stop swing end limit positions.

5. The latch system of claim 4 wherein said spring latch member is constructed as a one-piece member from semi-resilient plastic material having a low friction co-efficient, said mounting arm portion having a free end defining the maximum width dimension thereof in a plane parallel to the plane of pivotal motion travel, said mounting arm portion width dimension tapering to a narrower dimension at an integral junction with one end of said bight portion, said bight portion having a curved configuration in the plane of said surfaces extending about 130° to 140°, the opposite end of said bight portion having an integral junction with an end of said movable latch arm portion opposite and remote from said free end thereof and that defines the narrowest width dimension of said latch arm portion, said latch arm portion width dimension tapering wider from said narrowest dimension to said apex area of said camming surface and then diminishing in width to said latch arm portion free end, said flexing space tapering to its narrowest width dimension at said bight portion in the free state condition of said latch member.

6. The latch system of claim 5 wherein said cam follower means of said hinge arm comprises a first longitudinal edge surface of said hinge arm, a transverse end edge surface having a straight first portion extending generally perpendicular to said first longitudinal edge surface and merging therewith through a rounded comer edge surface, and a curved second portion of said transverse end edge surface extending smoothly from said end edge first portion with a uniform radius of curvature and merging with a second longitudinal edge surface of said hinge arm oriented parallel and laterally opposite said first longitudinal edge surface.

7. The latch system of claim 6 wherein said bracket means and said mobile arm are constructed and arranged such that said hinge arm second longitudinal edge surface abuttingly engages said bracket means to define said second stop position and said straight first portion of said transverse end edge surface abuttingly engages said bracket means to define said first stop position.

8. The latch system of claim 7 wherein said straight first portion extends at an included angle of about 95° with said hinge arm first longitudinal edge surface.

9. The latch system of claim 8 wherein said spring latch member is constructed of plastic material, and said bracket means and said mobile arm are constructed of aluminum material clad with an anti-corrosion protective coating.

10. The latch system of claim 8 wherein said bracket means comprises a metal right angle bracket of L-shaped cross section having a planar base flange adapted for fastener mounting to a support that is generally immobile in use, and having a planar latch mounting flange oriented generally perpendicular to said base flange, said spring latch member being mounted generally flat against said bracket mounting flange such that the pivotal motion plane of travel of said latch arm portion free end is adjacent and parallel to the major plane of said bracket mounting flange with said free end spaced slightly above said bracket base flange in its free state condition, said hinge arm one end being pivotally mounted to and also generally flat against said bracket mounting flange with said hinge arm cam follower edge surfaces operably oriented adjacent said camming surface of said latch member movable latch arm portion.

11. The latch system of claim 10 wherein said second longitudinal edge of said mobile arm abuts said bracket base flange in said second positive stop swing end limit position, and wherein said hinge arm transverse end edge surface straight first portion abuts said bracket base flange in said first positive stop swing end limit position.

12. The latch system of claim 11 wherein a planar plastic pad is mounted on said bracket base flange and oriented with its major plane perpendicular to the travel paths of said latch arm portion free end and said hinge arm transverse edge surface straight portion to thereby operate as an end limit stop cushion pad on said bracket base flange for abutment by said hinge arm transverse end edge surface straight first portion and by said latch arm portion free end at the respective end limits of their respective travel toward said bracket base flange.

13. The subassembly latch system of claim 1 assembled in further combination with a chair seat bottom construction comprising a seat bottom rear section having seat cushion material carried by a seat bottom rear section frame work in turn adapted to be fixedly mounted on a chair support, and a fold-up seat bottom front section also having seat cushion material carried by a seat bottom front section framework, said support bracket means being affixed to said rear section frame work and said hinge arm being affixed to said seat bottom front section framework and being oriented for pivotally supporting said front section as a generally horizontal extension of said seat bottom rear section when said hinge arm is yieldably latched in one of said swinging end limit positions, and for pivotally supporting said front section seat bottom to be folded upwardly and backwardly while being bodily carried by said hinge arm to a position disposed over said seat bottom rear section wherein said hinge arm is yieldably latched in the other of said swinging end limit positions.

14. The combination of claim 13 wherein a pair of said framework subassembly latch systems are constructed and arranged one at each side of said seat bottom sections and to operate in unison for tilt-up and tilt-down support of said seat bottom front section.

15. The combination of claim 13 wherein said chair seat bottom construction is further combined with a power boat driver-helmsman station having a chair support on which said seat bottom rear section is mounted, said station further having a steering wheel positioned to be gripped by a driver-helmsman when comfortably seated on said seat bottom section with said seat bottom front section folded-down, said seat bottom construction and steering wheel being oriented to provide a comfortable standing room space for the helmsman when gripping said steering wheel while standing in front of said seat bottom rear section with said seat bottom front section folded-up and back over said seat bottom rear section.

16. The combination of claim 13 wherein said bracket means is L-shaped and has a base flange mounted by a first set of fasteners to a frame board of said seat bottom rear section and a mounting flange mounted by a second set of fasteners to side board frame member of said seat bottom rear section.

17. The combination of claim 16 wherein said second set of fasteners is overlapped in assembly by said spring latch member and said spring latch member is attached to said bracket mounting flange by a pair of pop rivets finished off from the side of said bracket mounting flange remote from said associated side board frame member after installation of said second set of fasteners in said bracket mounting flange.

18. The combination of claim 16 wherein said hinge arm is pivoted to said bracket mounting flange by a pivot rivet having its head located on the side of said mounting flange remote from said hinge arm and being upset secured from the side of said hinge remote from said bracket mounting flange arm, and a plastic spacer washer is sleeved on the shank of said pivot rivet and interposed between said bracket mounting flange and said hinge arm to provide clearance space therebetween.

19. The combination of claim 18 wherein an abutment support pad is mounted on said bracket base flange for engagement by said cam follower means of said hinge arm to serve as an abutment stop in the fully tilted back position of said hinge arm.

20. The combination of claim 13 wherein said hinge arm one end and said support bracket means are constructed and arranged to form first and second mutual engagement positive stops defining the respective swing end limit positions of said hinge arm.

21. The combination of claim 20 wherein said cam follower means and said latch arm portion camming surface are constructed and arranged for disengagement when said hinge arm is in either one of said latched positions so that said spring latch member is in its free state condition when said hinge arm is in either of said latched positions thereof.

22. The combination of claim 21 wherein said hinge arm latched positions generally coincide with said hinge arm positive stop swing end limit positions.

23. The combination of claim 22 wherein said spring latch member is constructed as a one-piece member from semi-resilient plastic material having a low friction co-efficient, said mounting arm portion having a free end defining the maximum width dimension thereof in a plane parallel to the plane of pivotal motion travel, said mounting arm portion width dimension tapering to a narrower dimension at an integral junction with one end of said bight portion, said bight portion having a curved configuration in the plane of said surfaces extending about 130° to 140°, the opposite end of said bight portion having an integral junction with an end of said movable latch arm portion opposite and remote from said free end thereof and that defines the narrowest width dimension of said latch arm portion, said latch arm portion width dimension tapering wider from said narrowest dimension to said apex area of said camming surface and then diminishing in width to said latch arm portion free end, said flexing space tapering to its narrowest width dimension at said bight portion in the free state condition of said latch member.

24. The combination of claim 23 wherein said cam follower means of said hinge arm comprises a first longitudinal edge surface of said hinge arm, a transverse end edge surface having a straight first portion extending generally perpendicular to said first longitudinal edge surface and merging therewith through a rounded comer edge surface, and a curved second portion of said transverse end edge surface extending smoothly from said end edge first portion with a uniform radius of curvature and merging with a second longitudinal edge surface of said hinge arm oriented parallel and laterally opposite said first longitudinal edge surface.

25. The combination of claim 24 wherein said bracket means and said hinge arm are constructed and arranged such that said hinge arm second longitudinal edge surface abuttingly engages said bracket means to define said second stop position and said straight first portion of said transverse end edge surface abuttingly engages said bracket means to define said first stop position.

26. The combination of claim 25 wherein said straight first portion extends at an included angle of about 95° with said hinge arm first longitudinal edge surface.

27. The combination of claim 26 wherein said spring latch member is constructed of plastic material, and said bracket means and said hinge arm are constructed of aluminum material clad with an anti-corrosion protective coating.

28. The combination of claim 24 wherein said second longitudinal edge of said hinge arm abuts said bracket base flange in said second positive stop swing end limit position, and wherein said hinge arm transverse end edge surface straight first portion abuts said bracket base flange in said first positive stop swing end limit position.

29. The combination of claim 28 wherein a planar plastic pad is mounted on said bracket base flange and oriented with its major plane perpendicular to the travel paths of said latch arm portion free end and said hinge arm transverse end edge surface straight portion to thereby operate as an end limit stop cushion pad on said bracket base flange for abutment by said hinge arm transverse end edge surface straight first portion and by said latch arm portion free end at the respective end limits of their respective travel toward said bracket base flange.

30. The latch subassembly system of claim 1 wherein said spring latch member bight portion has a predetermined transverse width parallel to said plane of pivotal motion travel and aligned with said flexing space such that the effective overall spring rate of said spring latch member is suitably matched to the yieldable latching force required to stabilize said hinge arm in at least one of said latched positions thereof under the conditions of its intended use.

* * * * *